US009720430B2

(12) United States Patent
Koya

(10) Patent No.: US 9,720,430 B2
(45) Date of Patent: Aug. 1, 2017

(54) POWER CONTROL DEVICE

(71) Applicant: Daisuke Koya, Kanagawa (JP)

(72) Inventor: Daisuke Koya, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 438 days.

(21) Appl. No.: 14/454,928

(22) Filed: Aug. 8, 2014

(65) Prior Publication Data

US 2015/0057826 A1 Feb. 26, 2015

(30) Foreign Application Priority Data

Aug. 20, 2013 (JP) ..... 2013-170652

(51) Int. Cl.
*G05F 1/66* (2006.01)

(52) U.S. Cl.
CPC ..... *G05F 1/66* (2013.01)

(58) Field of Classification Search
CPC ..... G05F 1/66
USPC ..... 700/297
See application file for complete search history.

(56) References Cited

U.S. PATENT DOCUMENTS 5,918,380 A * 7/1999 Schleich ..... G01D 4/006 340/870.02
2006/0179353 A1* 8/2006 Kawata ..... G06F 11/1417 714/39
2011/0187440 A1* 8/2011 Yamaguchi ..... H03K 17/60 327/482
2014/0042811 A1* 2/2014 Myamoto ..... H02J 3/383 307/31

FOREIGN PATENT DOCUMENTS

JP 2011-180526 8/2011
JP 2012-175496 9/2012

* cited by examiner

*Primary Examiner* — Kenneth M Lo
*Assistant Examiner* — Yuhui R Pan
(74) *Attorney, Agent, or Firm* — Cooper & Dunham LLP

(57) ABSTRACT

A power control device includes a power unit generating power to be supplied to a target device, from external power, an operating unit receiving operation of power on and power off by a user, a nonvolatile memory unit storing information, and a power control unit turning off, when the operating unit has received power-off operation, power supply to the target device in a predetermined sequence for the target device and records the fact that power has been turned off normally in the nonvolatile memory unit. When external power supply is started, the power control unit turns on the power supply to the target device when having determined that external power supply was stopped due to a certain cause, or does not turn on the power supply to the target device when having determined that external power supply was stopped due to a cause other than the certain cause.

6 Claims, 9 Drawing Sheets

POWER CONTROL DEVICE

CROSS-REFERENCE TO RELATED APPLICATION(S)

The present application claims priority to and incorporates by reference the entire contents of Japanese Patent Application No. 2013-170652 filed in Japan on Aug. 20, 2013.

BACKGROUND OF THE INVENTION

1. Field of the Invention

The present invention relates to a power control device.

2. Description of the Related Art

Conventionally, the image forming apparatus includes a rocker switch as a power switch. However, recently, the image forming apparatus often includes a push switch that can turn off the power to main functions while receiving external power. In such an image forming apparatus including a push switch, timer control of power on or off, or other controls can be implemented.

Moreover, there is known an image forming apparatus having a function of allowing automatic recovery when the supply of external power is restarted after power failure. Such an image forming apparatus can solve the problem that the functions remain stopped even when the supply of external power is restarted after power failure, for example, the problem that facsimiles cannot be received after power failure, for example.

Furthermore, recently, there has been developed a power tap that stops and starts power supply by remote control. Such a power tap allows a user to stop and start power supply to an electronic device, from the outside, for example. Conventional examples are described in Japanese Patent Publication Laid-open No. 2012-175496 and Japanese Patent Publication Laid-open No. 2011-160526. However, when the image forming apparatus having a function of automatic recover after power failure is connected to a power tap enabling stop and start of power supply by remote control, the image forming apparatus allows automatic recovery even in a case other than power failure, once the power supply is started, by power control, after the state where the power supply is stopped.

Therefore, it is desirable to provide a power control device that allows automatic recovery when the supply of external power is restarted after the supply of external power was stopped due to a certain cause such as power failure and does not allow automatic recovery when the supply of external power is restarted after the supply of external power was stopped due to a cause other than the certain cause.

SUMMARY OF THE INVENTION

It is an object of the present invention to at least partially solve the problems in the conventional technology.

According to an aspect of the present invention, there is provided a power control device including: a power unit that generates power to be supplied to a target device, from external power; an operating unit that receives operation of power on and power off by a user; a nonvolatile memory unit that stores therein information; and a power control unit that turns off, when the operating unit has received operation of power off, supply of the power to the target device in a predetermined sequence for the target device and records a fact that power has been turned off normally in the nonvolatile memory unit, wherein when supply of the external power is started, the power control unit determines whether the supply of the external power was stopped due to a certain cause when the fact that the power has been turned off normally is not recorded in the nonvolatile memory unit, and turns on the supply of the power to the target device when the power control unit has determined that the supply of the external power was stopped due to the certain cause, or does not turn on the supply of the power to the target device when the power control unit has determined that the supply of the external power was stopped due to a cause other than the certain cause.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

In the following, embodiments of the invention will be described in detail with reference to the enclosed drawings. Note that the embodiments do not limit the invention.

Figure 1:
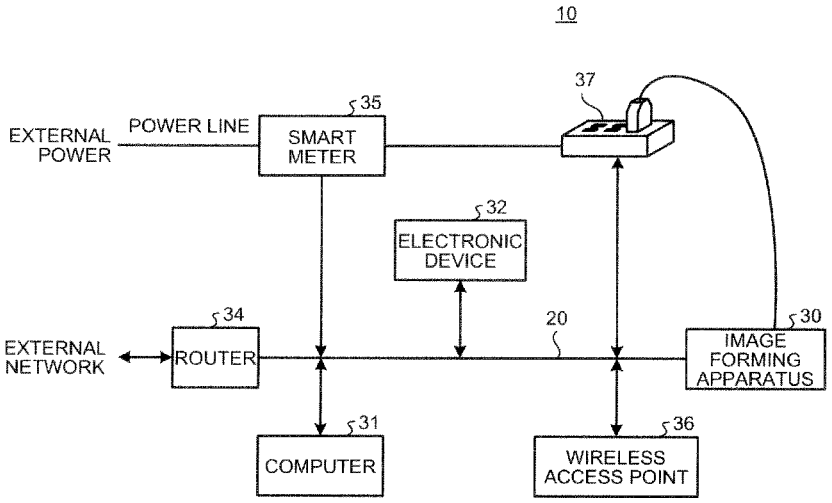
FIG. 1 is a diagram illustrating a configuration of an in-house system according to an embodiment of the present invention.

FIG. 1 is a diagram illustrating a configuration of an in-house system 10 according to an embodiment. The in-house system 10 is a system in which electronic devices used at home are connected through a network 20. The network 20 may be either wireless or wired.

The in-house system 10 includes an image forming apparatus 30, a computer 31, an electronic device 32, a router 34, a smart meter 35, a wireless access point 36, and a power tap 37, for example. The image forming apparatus 30 is a device having a scanner function, a plotter function, and a facsimile function, for example. The image forming apparatus 30 is an example of a target device to be power controlled. However, in the invention, a target device to be power controlled is not limited to the image forming apparatus 30. For example, the target device may be an image processing apparatus (a projector, for example) other than the image forming apparatus 30, or an information processing device such as a personal computer.

The computer 31 is a personal computer. The electronic device 32 is a device that can be connected to the network 20, such as a television, an audio device, and electric appliances.

The router 34 is a connection device for connection to an external network. The smart meter 35 is a wattmeter having a clock function and measures power consumption at home for each time slot. The smart meter 35 records measured power consumption in an inner nonvolatile memory, for example, and transmits the information to a server of a power company, for example, through the network 20. The wireless access point 36 performs wireless communication with an information terminal and relays access between each device on the network 20 and the information terminal, for example.

The power tap 37 has terminals, one of which is connected to an outlet provided on a wall of a house, for example, and the other terminals thereof each are connected to a power cable of an electronic device, so that external power (alternating current (AC) power) can be supplied to the electronic device. The power tap 37 enables remote control of stop and start of the supply of external power to an electronic device, through the network 20, for example. In the embodiment, the image forming apparatus 30 receives the supply of external power through the power tap 37.

Figure 2:
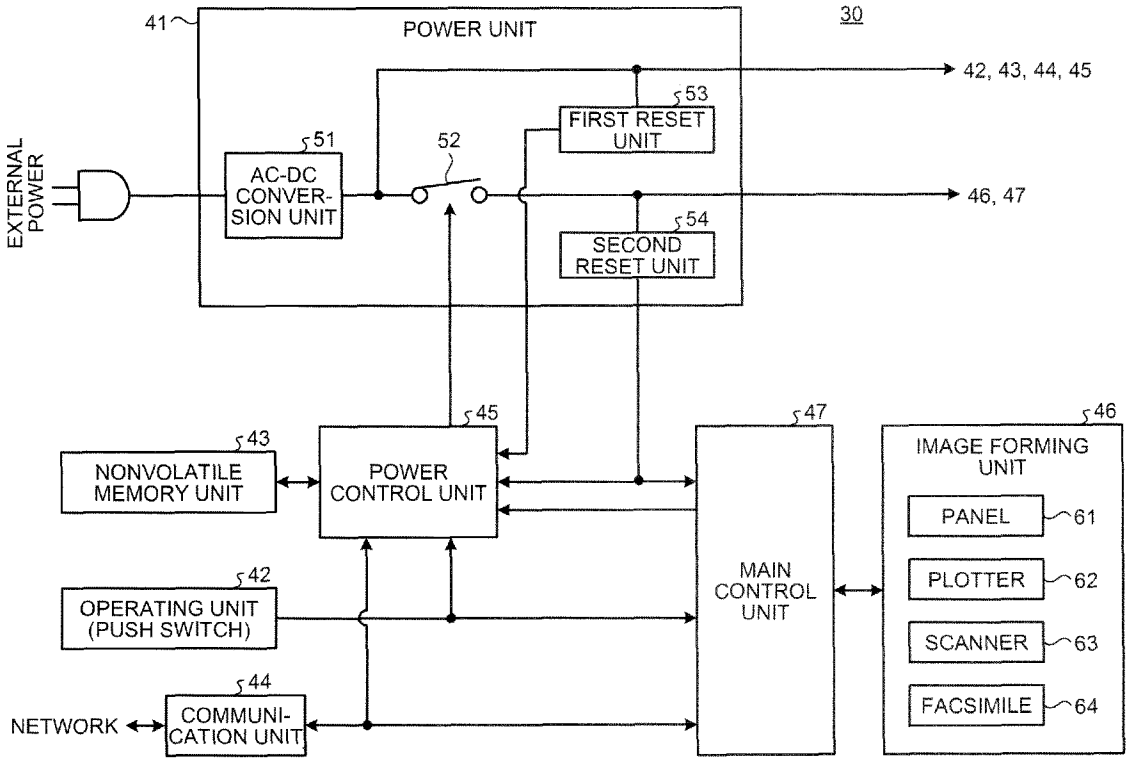
FIG. 2 is a diagram illustrating a configuration of an image forming apparatus according to the embodiment.

FIG. 2 is a diagram illustrating a configuration of the image forming apparatus 30 according to the embodiment. The image forming apparatus 30 includes a power unit 41, an operating unit 42, a nonvolatile memory unit 43, a communication unit 44, a power control unit 45, an image forming unit 46, and a main control unit 47.

The power unit 41 includes an alternating current-direct current (AC-DC) conversion unit 51, a switch 52, a first reset unit 53, and a second reset unit 54. The AC-DC conversion unit 51 receives external power (AC power, for example) from the power tap 37 and converts the external power into DC power.

The switch 52 switches whether DC power generated by the AC-DC conversion unit 51 is to be output to the outside. To be more specific, the switch 52 outputs, in the on-state, power generated by the AC-DC conversion unit 51 to the outside, and does not output, in the off-state, the power to the outside. The on-state and off-state of the switch 52 is controlled by the power control unit 45. The switch 52 is off in the initial state (when the supply of external power is started).

The first reset unit 53 resets the power control unit 45. The second reset unit 54 resets the power control unit 45 and the main control unit 47.

The power unit 41 supplies DC power output from the AC-DC conversion unit 51 directly to a power control block (operating unit 42, nonvolatile memory unit 43, and power control unit 45) of the image forming apparatus 30 and a communication function block (communication unit 44) of the image forming apparatus 30. Note that the power control block and the communication function block serve as a power control device.

The power unit 41 supplies DC power output through the switch 52 to a main function block (image forming unit 46 and main control unit 47) of the image forming apparatus 30. Note that when the communication function is not used when the power is off, the power unit 41 may supply DC power output through the switch 52 to the communication function block (communication unit 44) of the image forming apparatus 30.

The operating unit 42 receives operation of power on and power off by a user. The operating unit 42 is a push switch that notifies whether the user presses it, for example.

The nonvolatile memory unit 43 stores therein written information. The nonvolatile memory unit 43 continues to old stored information even when the power supply is cut off. The nonvolatile memory unit 43 is a flash memory, for example. The communication unit 44 is connected to an external device through the network 20.

The power control unit 45 controls the power unit 41, and writes and reads out information in and from the nonvolatile memory unit 43, for example. The power control unit 45 is an integrated circuit (IC) for control including an arithmetic processing unit, a random access memory (RAM), a read only memory (ROM), and a bus interface, for example.

The power control unit 45 controls the switch 52 of the power unit 41 in accordance with operation of the operating unit 42, for example. To be more specific, when the operating unit 42 has received operation of power on (operation of pressing the operating unit 42 when the power is off) by a user, the power control unit 45 switches the switch 52 of the power unit 41 from the off-state to the on-state, in this manner, the power control unit 45 starts the supply of DC power to the image forming unit 46 and the main control unit 47 so as to activate main functions of the image forming apparatus 30.

Moreover, when the operating unit 42 has received operation of power off (operation of pressing the operating unit 42 when the power is on) by a user, the power control unit 45 switches the switch 52 from the on-state to the off-state. In this manner, the power control unit 45 stops the supply of DC power to the image forming unit 46 and the main control unit 47 so as to stop main functions of the image forming apparatus 30.

Note that when the operating unit 42 has received operation of power off by a user, the power control unit 45 switches the switch 52 from the on-state to the off-state after the main control unit 47 executes a predetermined sequence for power off. Furthermore, when the main control unit 47 has executed the predetermined sequence for power off, the power control unit 45 records the fact that the power has been turned off normally in the nonvolatile memory unit 43.

The image forming unit 46 forms, on a paper sheet, an image in accordance with image data. The image forming unit 46 includes a panel 61, a plotter 62, a scanner 63, and a facsimile 64, for example.

The panel 61 receives information input by a user, or displays information to the user. The plotter 62 prints an image in accordance with image data onto a paper sheet. The scanner 63 reads out an image printed on a paper sheet and generates image data. The facsimile 64 transmits and receives image data through a telephone line.

The main control unit 47 controls the entire of the image forming apparatus 30. The main control unit 47 includes various interfaces for controlling a central processing unit (CPU), a RAM, a ROM, a flash memory, and other devices, and a hard disk drive, for example.

When the operating unit 42 has received operation of power on by a user, and then the power unit 41 has started the supply of DC power, the main control unit 47 executes a predetermined sequence for power on. For example, the main control unit 47 performs the sequence for power on, such as processing of activating or initiating a hard disk drive, a flash memory, and functions in the image forming unit 46, in a certain order.

When the operating unit 42 has received operation of power off by a user, the main control unit 47 executes a predetermined sequence for power off. For example, the main control unit 47 performs the sequence for power off, such as processing of storing information stored in a RAM into a hard disk drive or a flash memory, for example, or of stopping the hard disk drive, the flash memory, and the functions in the image forming unit 46, in a certain order Then, when the sequence for power off has been finished normally, the main control unit 47 notifies the power control unit 45 of the fact that the power has been turned off normally.

In the image forming apparatus 30 having the configuration described above, DC power is supplied to all function blocks when the power is on. Moreover, when the power to the image forming apparatus 30 is off, the supply of DC power to the main function block (image forming unit 46 and main control unit 47) is stopped, while the supply of DC power to the power control block (operating unit 42, nonvolatile memory unit 43, and power control unit 45) and the communication function block (communication unit 44) is maintained. Note that when the communication function is not used while the power is off, the image forming apparatus 30 may stop the supply of DC power to the communication function block (communication unit 44) when the power is off.

Moreover, when the power state of the image forming apparatus 30 is shifted from on to off, the functions of the main function block are stopped in a given sequence, and then the supply of DC power to the main function block is stopped. Furthermore, in the image forming apparatus 30, when the functions of the main function block have been stopped normally in the given sequence, the fact that the power has been turned off normally is written in the nonvolatile memory unit 43. Moreover, when the power state of the image forming apparatus 30 is shifted from off to on, the supply of DC power to the main function block is started, and then the main function block is activated in a given sequence.

In the image forming apparatus 30 having such a configuration, when the supply of external power to the power unit 41 is stopped, the supply of DC power to all function blocks is stopped.

When the supply of external power to the power unit 41 is started after the state where the supply of external power is stopped, the image forming apparatus 30 switches whether DC power is to be supplied to the main function block (image forming unit 46 and main control unit 47), depending on a cause of stop of the supply of external power. To be more specific, the image forming apparatus 30 supplies DC power to the main function block when the cause of stop of the supply of external power is a certain cause (power failure, for example), and does not supply DC power to the main function block when the cause is different from the certain cause.

Figure 3:
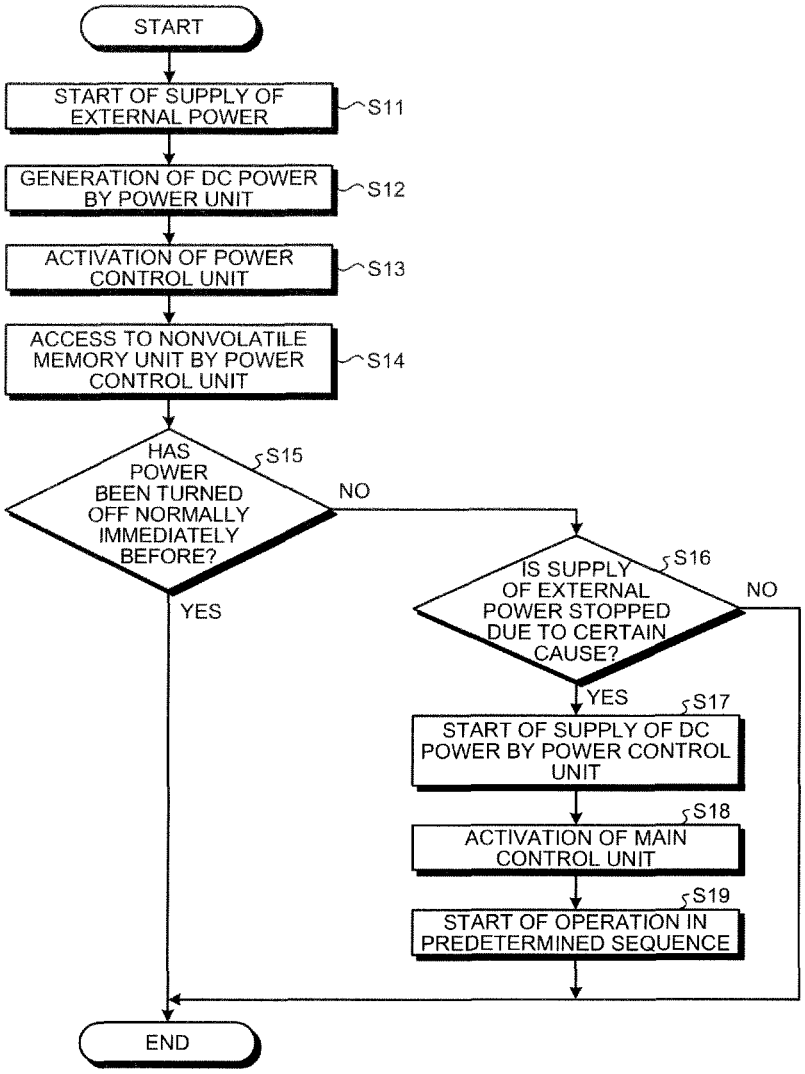
FIG. 3 is a diagram illustrating a processing flow of the image forming apparatus when the supply of external power is started after the state where the supply of power supply is stopped.

FIG. 3 is a diagram illustrating a processing flow of the image forming apparatus 30 when the supply of external power is started after the state where the supply of power supply is stopped.

First, at Step S11, the supply of external power is started after the state where the supply of external power is stopped. Next, at Step S12, the power unit 41 generates DC power from the external power.

Next, at Step S13, the power control unit 45 receives DC power from the power unit 41 and is activated. Next, at Step S14, the power control unit 45 accesses the nonvolatile memory unit 43 to read out information. At Step S15, The power control unit 45 determines whether the fact that the power has been turned off normally by the preceding action is recorded in the nonvolatile memory unit 43.

When the fact that the power has been turned off normally is recorded in the nonvolatile memory unit 43 (Yes at Step S15), the power control unit 45 finishes the processing immediately. Here, when the supply of external power is started, the switch 52 is in the initial state (off-state). Thus the power control unit 45 finishes the processing immediately, thereby cutting off the supply of DC power to the image forming unit 46 and the main control unit 47. For example, when a user presses the operating unit 42 (a push button) to turn off the power to the image forming apparatus 30 and then pulls off a power cable of the image forming apparatus 30 from the power tap 37 to stop the supply of external power, the fact that the power has been turned off normally is recorded in the nonvolatile memory unit 43. When the fact that the power has been turned off normally is recorded in the nonvolatile memory unit 43, the power control unit 45 finishes processing immediately, thereby restoring the state of the image forming apparatus 30 (off-state) immediately before the supply of external power was stopped.

When the fact that the power has been turned off normally is not recorded in the nonvolatile memory unit 43 (No at Step S15), the power control unit 45 advances the processing to Step S16. At Step S16, the power control unit 45 determines whether the supply of external power was stopped due to a certain cause. Here, the certain cause is power failure, for example.

When the power control unit 45 has determined that the supply of external power thereto was stopped due to the certain cause (power failure, for example) (Yes at Step S16), it advances the processing to Step S17. At Step S17, The power control unit 45 switches the switch 52 of the power unit 41 from the off-state to the on-state, and starts the supply of DC power to the main control unit 47 and the image forming unit 46.

Subsequently, at Step S18, the main control unit 47 receives DC power from the power unit 41 and is activated. Next, at Step S19, the main control unit 47 executes the predetermined sequence for power on to start the operation of each function. To be more specific, the main control unit 47 performs processing of initializing or activating the hard disk drive, the flash memory, and the functions in the image forming unit 46 in a certain order. Then, once the execution of the sequence for power on is completed, the main control unit 47 finishes the main flow.

In this manner, when the supply of external power was stopped due to a certain cause (power failure, for example) different from user's intention, the power control unit 45 can restore the state of the image forming apparatus 30 (on-state) immediately before the supply of external power was stopped.

By contrast, when the power control unit 45 has determined that the supply of external power thereto was stopped due to a cause other than the certain cause (No at Step S16), it finishes the processing immediately. It is assumed that the stop of power supply due to a cause other than the certain cause will occur when a user has pulled off a power cable from the power tap 37 while the power is on or has stopped power supply from the power tap 37 by remote control. That is, it is assumed that the stop of power supply due to a cause other than the certain cause may be a stop of power supply corresponding to user's intention. When the power control unit 45 has determined that the supply of external power thereto was stopped due to a cause other than the certain cause, it finishes processing immediately, and the image forming apparatus 30 can be off in accordance with user's intention.

In this manner, the image forming apparatus 30 allows automatic recovery when the supply of external power is restarted after the supply of external power was stopped due to the certain cause (power failure, for example), and does not allow automatic recovery when the supply of external power is restarted after the supply of external power was stopped due to a cause other than the certain cause. Furthermore, the image forming apparatus 30 does not allow automatic recovery when the supply of external power was stopped due to a cause other than the certain cause (power failure, for example), and thus the power recovery after the sequence for power off was not properly done is limited, which is preferable in terms of safety.

Figure 4:
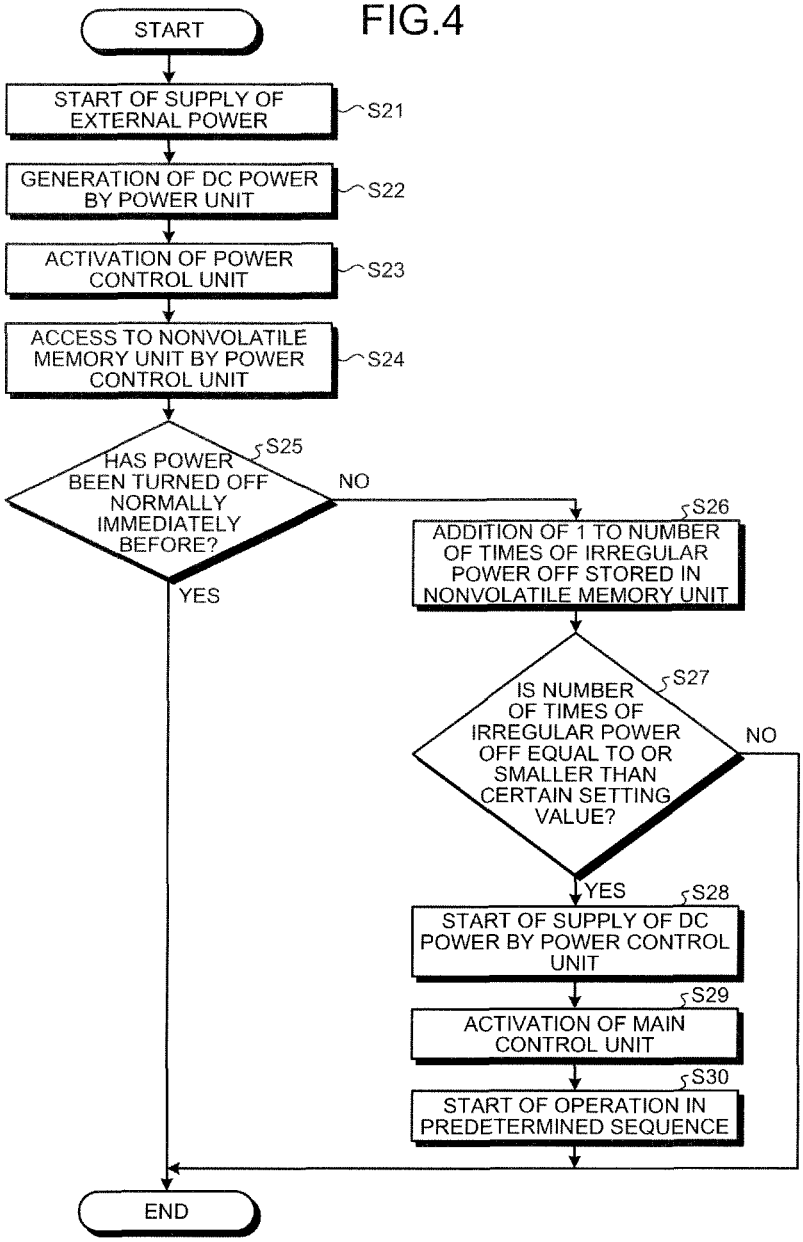
FIG. 4 is a diagram illustrating a processing flow of a first concrete example of the image forming apparatus.

FIG. 4 is a diagram illustrating a processing flow of a first concrete example of the image forming apparatus 30. When the supply of external power is started, the image forming apparatus 30 may perform the following processing from Step S21 to Step S30.

Through Step S21 to Step S25, the power control unit 45 performs the same processing as the processing from Step S11 to S15 in FIG. 3. At Step S25, if it is determined that the fact that the power has been turned off normally is not recorded in the nonvolatile memory unit 43 (No at Step S25), the power control unit 45 advances the processing to Step S26.

At Step S26, The power control unit 45 adds 1 to the number of times of irregular power off stored in the nonvolatile memory unit 43. Note that the number of times of irregular power off stored in the nonvolatile memory unit 43 is a count in a certain period of time (one month, for example), as an example.

Subsequently, at Step S27, the power control unit 45 determines whether the number of times of irregular power off is equal to or smaller than a setting value. When the power control unit 45 has determined that the number of times of irregular power off is equal to or smaller than the setting value (Yes at Step S27), it advances the processing from Step S28 to Step S30. Through Step S28 to Step S30, the power control unit 45 and the main control unit 47 perform the same processing as the processing from Step S17 to S19 in FIG. 3.

By contrast, when the power control unit 45 has determined that the number of times of irregular power off is larger than the certain setting value (No at Step S27), it finishes the processing immediately.

In the first concrete example, when the number of times of irregular power off is equal to or smaller than a setting value in a certain period of time, the power control unit 45 assumes that the stop of the supply of external power might be due to power failure because the frequency of power failure is generally low. When the number of times of irregular power off is larger than a setting value, the power control unit 45 assumes that the stop of the supply of external power might not be due to power failure. Note that the setting value is preferably changed depending on a use environment. For example, the power control unit 45 sets five times per month as a setting value, because power failure occurs at a very low frequency in Japan.

In the first concrete example, the determination is made based on the comparison between the number of times of irregular power off and a setting value. Thus, the power control unit 45 can easily determine whether the supply of external power was stopped due to power failure.

Figure 5:
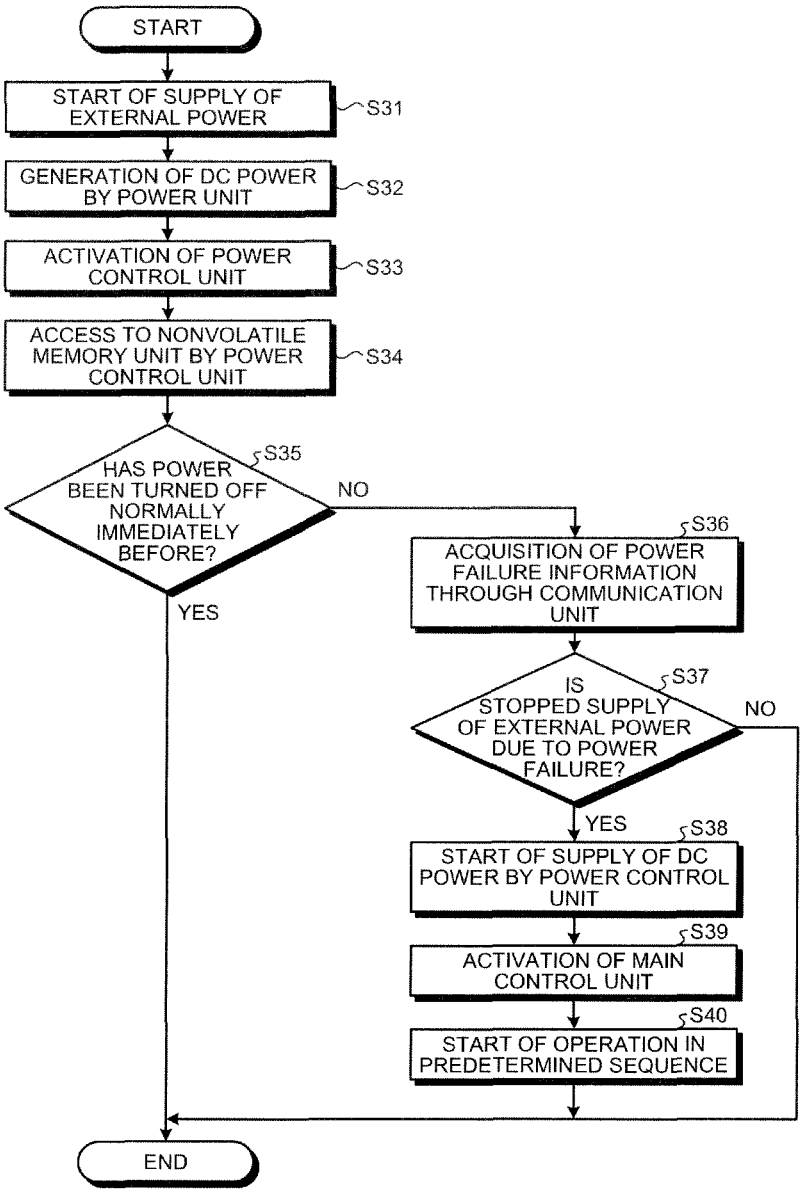
FIG. 5 is a diagram illustrating a processing flow of a second concrete example of the image forming apparatus.

FIG. 5 is a diagram illustrating a processing flow of a second concrete example of the image forming apparatus 30. When the supply of external power is started, the image forming apparatus 30 may perform the following processing from Step S31 to Step S40.

Through Step S31 to Step S35, the power control unit 45 performs the same processing as the processing from Step S11 to S15 in FIG. 3. At Step S35, if it is determined that the fact that the power has been turned off normally is not recorded in the nonvolatile memory unit 43 (No at Step S35), the power control unit 45 advances the processing to Step S36.

At Step S36, the power control unit 45 acquires power failure information indicating a place and time at which power failure occurred, from an external server (a server of a power company or a private business providing power failure information, for example) through the communication unit 44. Subsequently, at Step S37, the power control unit 45 determines whether the supply of external power was stopped due to power failure until the time immediately before the supply of external power is started, based on the acquired power failure information.

When the power control unit 45 has determined that the supply of external power thereto was stopped due to power failure (Yes at Step S37), it advances the processing from Step S38 to Step S40. Through Step S38 to Step S40, the power control unit 45 and the main control unit 47 perform the same processing as the processing from Step S17 to S19 in FIG. 3.

By contrast, when the power control unit 45 has determined that the supply of external power thereto was not stopped due to power failure (No at Step S37), it finishes the processing immediately.

In the second concrete example, the determination is based on the acquired power failure information provided from an external server and other components. Thus, the power control unit 45 can accurately determine whether the supply of external power was stopped due to power failure.

Figure 6:
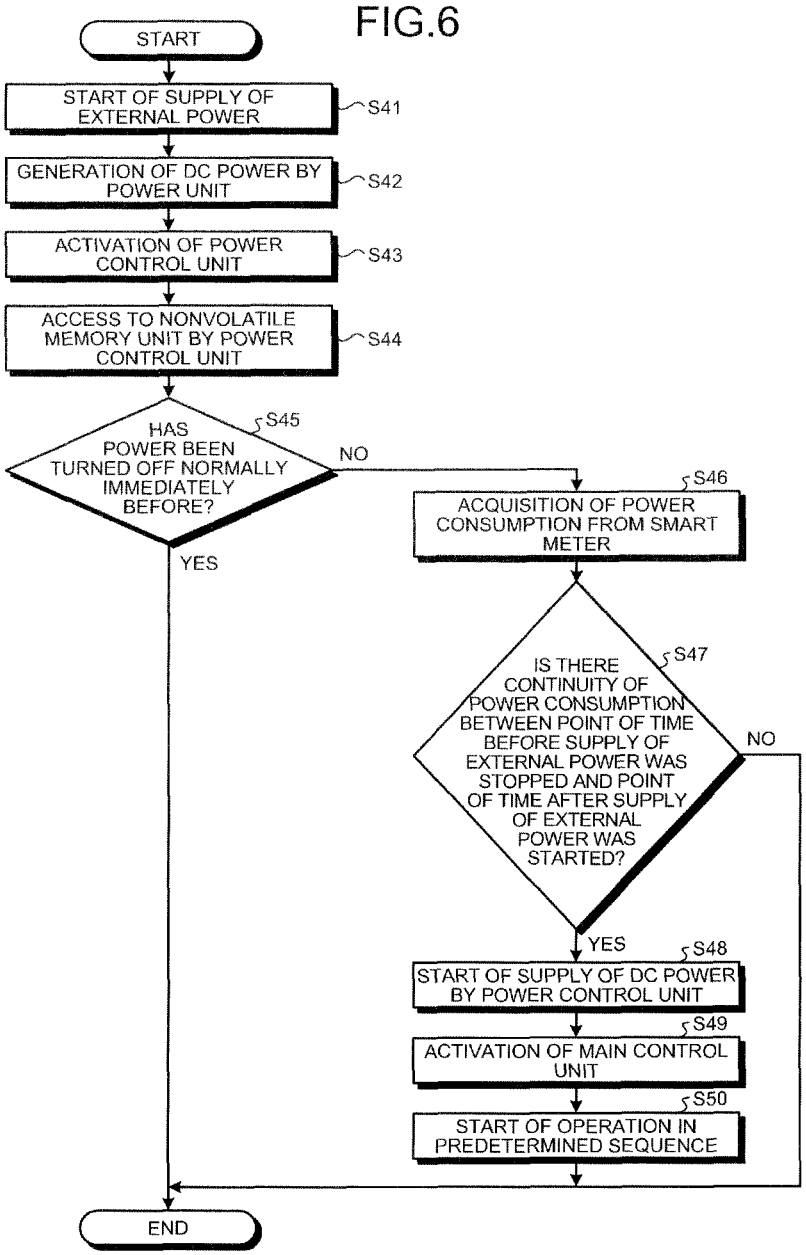
FIG. 6 is a diagram illustrating a processing flow of a third concrete example of the image forming apparatus.

FIG. 6 is a diagram illustrating a processing flow of a third concrete example of the image forming apparatus 30 when the supply of external power is started. When the supply of external power is started, the image forming apparatus 30 may perform the following processing from Step S41 to Step S50.

Through Step S41 to Step S45, the power control unit 45 performs the same processing as the processing from Step S11 to Step S15 in FIG. 3. At Step S45, if it is determined that the fact that the power has been turned off normally is not recorded in the nonvolatile memory unit 43 (No at Step S45), the power control unit 45 advances the processing to Step S46.

At Step S46, The power control unit 45 acquires power consumption from the smart meter 35 on the network 20 through the communication unit 44.

At Step S47, the power control unit 45 determines whether the supply of external power was stopped due to power failure, based on the acquired power consumption. To be more specific, the power control unit 45 determines whether there is the continuity of power consumption between a point of time before the supply of external power was stopped and a point of time after the supply of external power was started. When the continuity exists, the power control unit 45 determines that the supply of external power thereto was stopped due to power failure.

Here, when the power failure occurs, all of power supply at home is stopped, and the total power consumption at home does not increase. By contrast, when the supply of external power to the image forming apparatus 30 is exclusively stopped, the total power consumption at home increases because other home electric appliances consume power.

When there is the continuity of power consumption between a point of time before the supply of external power was stopped and a point of time after the supply of external power was started, that is, when no power was consumed by other devices between a point of time when the supply of external power was stopped and a point of time when the supply of external power was started, the power control unit 45 determines that the supply of external power thereto was stopped due to power failure. By contrast, when there is no continuity of power consumption between a point of time before the supply of external power was stopped and a point of time after the supply of external power was started, that is, when power was consumed by other devices between a point of time when the supply of external power was stopped and a point of time when the supply of external power was started, the power control unit 45 determines that the supply of external power thereto was stopped due to a cause other than power failure.

When the power control unit 45 has determined that the supply of external power thereto was stopped due to power failure (Yes at Step S47), it advances the processing from Step S48 to Step S50. Through Step S48 to Step S50, the power control unit 45 and the main control unit 47 perform the same processing as the processing from Step S17 to Step S19 in FIG. 3.

By contrast, when the power control unit 45 has determined that the supply of external power thereto was not stopped due to power failure (No at Step S47), it finishes the processing immediately.

In the third concrete example, the determination of whether power failure occurred is made after accessing devices at home. Thus, the power control unit 45 can receive more accurate information of the home and determine more accurately whether the supply of external power was stopped due to power failure.

Figure 7:
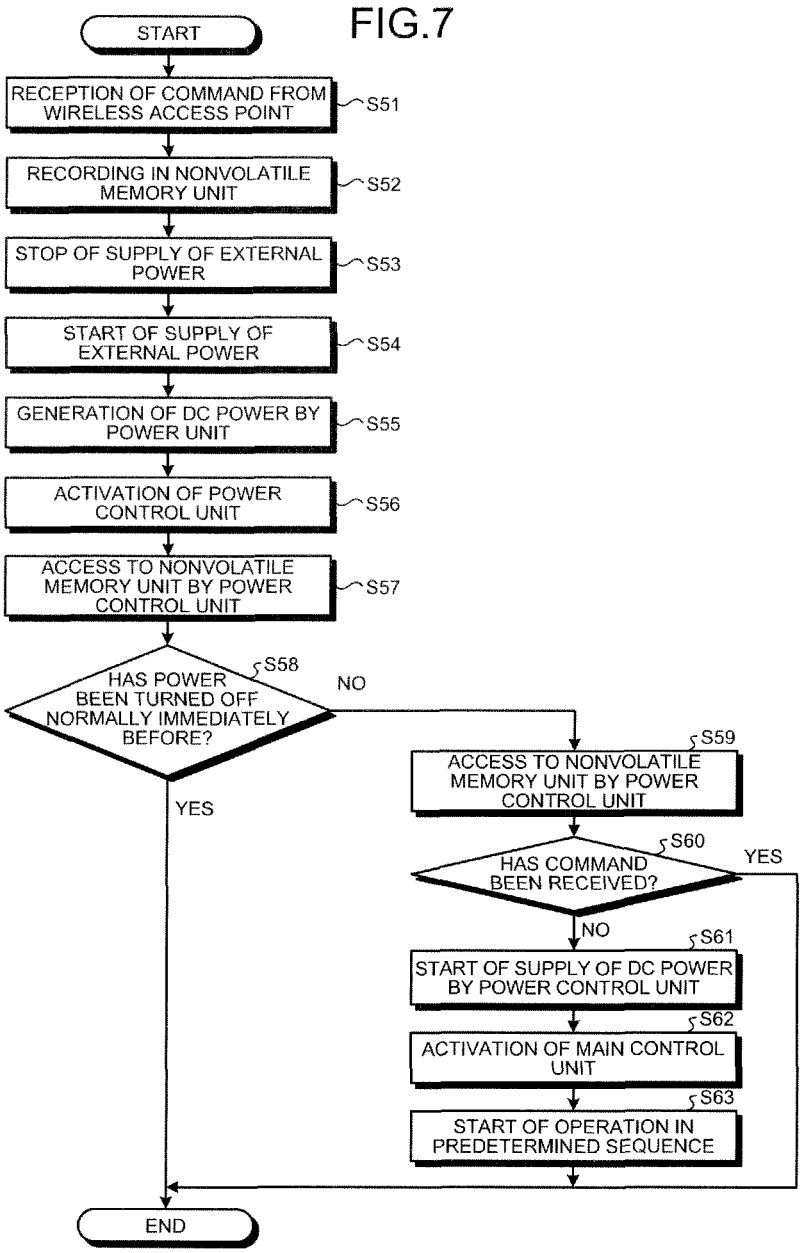
FIG. 7 is a diagram illustrating a processing flow of a fourth concrete example of the image forming apparatus.

FIG. 7 is a diagram illustrating a processing flow of a fourth concrete example of the image forming apparatus 30. When the supply of external power is started after a certain period of time has elapsed from the stop of the supply of external power, the image forming apparatus 30 may perform the following processing from Step S51 to Step S63, for example.

First, at Step S51, the power control unit 45 receives information indicating that a command for stopping power supply has been provided to the power tap 37, from the wireless access point 36 through the communication unit 44. Note that, for example, having received a command for stopping power supply to the power tap 37 from an external information terminal, the wireless access point 36 notifies the image forming apparatus 30 of the reception.

Next, at Step S52, the power control unit 45 records the fact that a command for stopping power supply has been provided to the power tap 37, in the nonvolatile memory unit 43. At Step S53, the supply of external power is stopped, and the power unit 41 stops generation of DC power.

Subsequently, when the power supply is restarted, the power control unit 45 performs, through Step S54 to Step S58, the same processing as the processing from Step S11 to Step S15 in FIG. 3. At Step S58, if it is determined that the fact that the power has been turned off normally is not recorded in the nonvolatile memory unit 43 (No at Step S58), the power control unit 45 advances the processing to Step S59.

At Step S59, the power control unit 45 accesses the nonvolatile memory unit 43 to read out information. At Step S60, the power control unit 45 determines whether the supply of external power was stopped because a command for stopping power supply has been provided to the power cap 37, based on the information read out from the nonvolatile memory unit 43.

When the power control unit 45 has determined that a command for stopping power supply has not been provided to the power tap 37 but the supply of external power thereto was stopped (No at Step S60), it advances the processing from Step S61 to Step S63. Through Step S61 to Step S63, the power control unit 45 and the main control unit 47 perform the same processing as the processing from Step S17 to S19 in FIG. 3.

By contrast, when the power control unit 45 has determined that a command for stopping power supply has been provided to the power tap 37 and the supply of external power thereto was stopped (Yes at Step S60), it finishes the processing immediately. In the fourth concrete example, the determination is made based on a command provided to the power tap 37. Thus, the power control unit 45 can accurately determine whether a user has stopped the power supply with his/her own intention.

Figure 8:
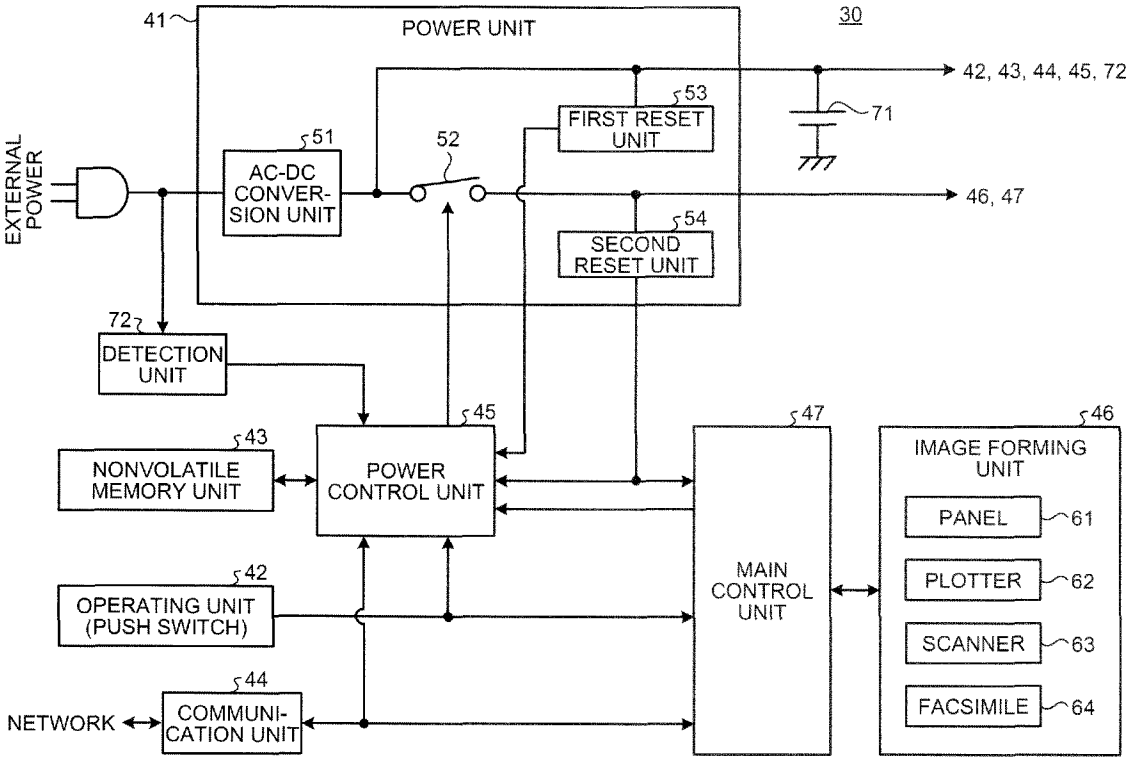
FIG. 8 is a diagram illustrating a configuration of an image forming apparatus according to a modification.

FIG. 8 is a diagram illustrating a configuration of an image forming apparatus 30 according to a modification. The image forming apparatus 30 of the modification has the substantially same configuration and functions as the image forming apparatus 30 illustrated in FIG. 2. Hence, the components having the substantially same configuration and functions are represented with the same symbols, and the explanation of such components other than different points is omitted.

The image forming apparatus 30 of the modification further includes a secondary cell 71 and a detection unit 72. The secondary cell 71 is provided on a DC power supply line from the power unit 41 to the power control unit 45 and other components. Thus, the secondary cell 71 can supply power to the power control unit 45 and other components when the supply of external power is stopped.

The detection unit 72 detects whether the supply of external power to the power unit 41 is stopped. DC power from the AC-DC conversion unit 51 is supplied to the detection unit 72 without going through the switch 52. This configuration allows the detection unit 72 to be supplied with DC power from the secondary cell 71 even when the supply of external power is stopped, and to continue operation. The detection unit 72 notifies the power control unit 45 of the detected information.

Figure 9:
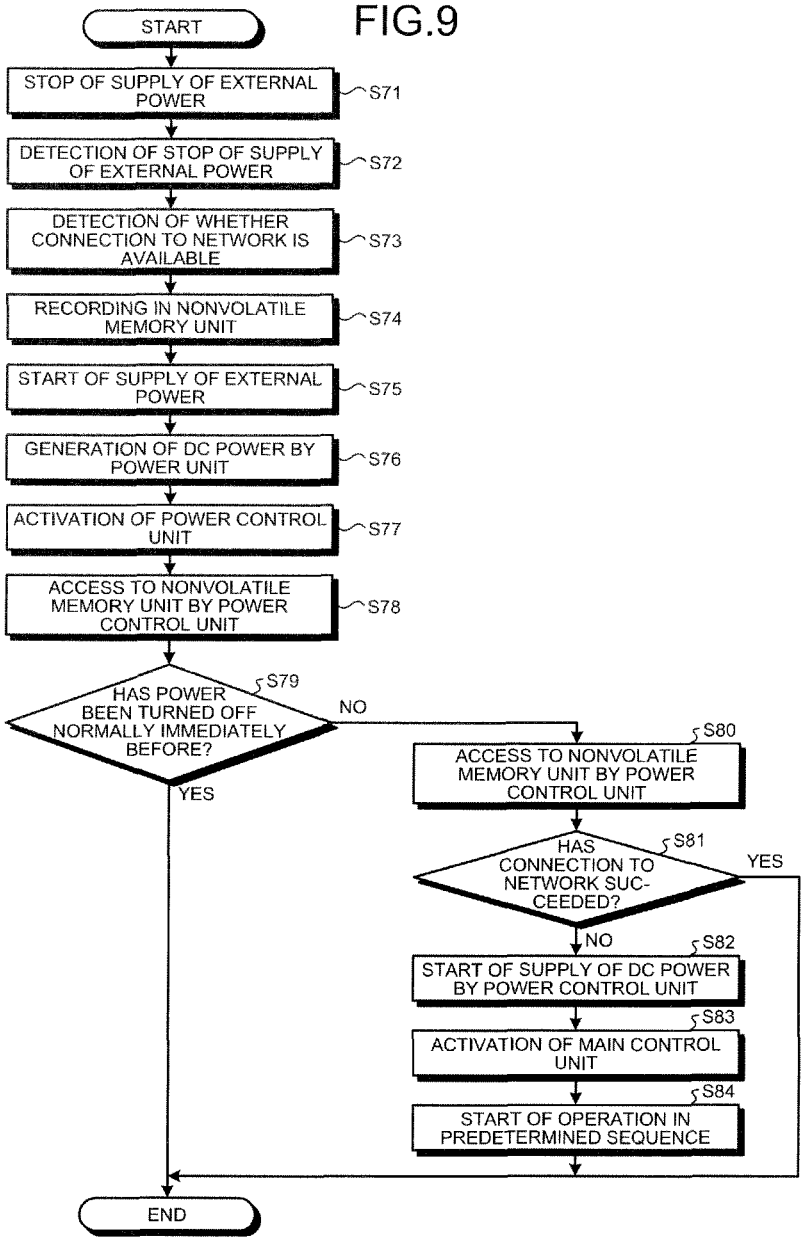
FIG. 9 is a diagram illustrating a processing flow of a concrete example of the image forming apparatus according to the modification.

FIG. 9 is a diagram illustrating a processing flow of a concrete example of the image forming apparatus 30 according to the modification. When the supply of external power is started after a certain period of time has elapsed from the stop of the supply of external power, the image forming apparatus 30 having the configuration illustrated in FIG. 8 may perform the following processing from Step S71 to Step S84, for example.

First, at Step S71, when the supply of external power from the power tap 37 is stopped, the power unit 41 stops generation of DC power. Next, at Step S72, the detection unit 72 detects that the supply of external power is stopped and notifies the power control unit 45 of the fact.

Subsequently, at Step S73, the power control unit 45 detects whether the connection to the network 20 through the communication unit 44 is available. In the case of power failure, for example, the power supply to all of electronic devices at home is stopped, which disables the connection of the power control unit 45 to the network 20. By contrast, when a user intentionally stops the power supply from the power tap 37, for example, the power supply to other electronic devices is not stopped, and thus the connection of the power control unit 45 to the network 20 is available. Subsequently, at Step S74, the power control unit 45 records a detection result of whether the connection to the network 20 is available in the nonvolatile memory unit 43.

Then, once the power supply is restarted, the power control unit 45 performs, through Step S75 to Step S79, the same processing as the processing from Step S11 to Step S15 in FIG. 3. At Step S79, if it is determined that the fact that the power has been turned off normally is not recorded in the nonvolatile memory unit 43 (No at Step S79), the power control unit 45 advances the processing to Step S80.

At Step S80, the power control unit 45 accesses the nonvolatile memory unit 43 to read out information. Next, at Step S81, the power control unit 45 determines whether the connection to the network 20 has succeeded while the supply of external power thereto is stopped, based on the information read out from the nonvolatile memory unit 43.

When the power control unit 45 has determined that the connection to the network 20 has failed while the supply of external power thereto is stopped (No at Step S81), it advances the processing from Step S82 to Step S84. Through Step S82 to Step S84, the power control unit 45 and the main control unit 47 perform the same processing as the processing from Step S17 to S19 in FIG. 3.

By contrast, when the connection to the network 20 has succeeded while the supply of external power thereto is stopped (Yes at Step S81), the power control unit 45 finishes the processing immediately. In the concrete example, the power control unit 45 is operated with the secondary cell 71 while the supply of external power is stopped, thereby determining whether the connection to the network 20 is available. Thus, the power control unit 45 can accurately determine whether the supply of external power was stopped due to power failure without acquiring information from other devices.

Note that although the above embodiments describe the cases in which the invention is applied to the image forming apparatus 30, the invention is applicable to power control of not only the image forming apparatus 30 but also any kinds of electronic devices.

The embodiment allows automatic recovery when the supply of external power is restarted after the supply of external power was stopped due to a certain cause such as power failure and does not allow automatic recovery when the supply of external power is restarted after the supply of external power was stopped due to a cause other than the certain cause.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A power control device comprising:

a communication unit connected to an external device through a network;

a power unit that generates power to be supplied to a target device, from external power;

an operating unit that receives operation of power on and power off by a user;

a nonvolatile memory unit that stores therein information; and a power control unit that turns off, when the operating unit has received operation of power off, supply of the power to the target device in a predetermined sequence for the target device and records a fact that power has been turned off normally in the nonvolatile memory unit, wherein when a command for stopping power supply has been provided to a power tap to which the target device is connected, the power control unit receives a fact that the command for stopping power supply has been provided to the power tap, through the communication unit, and records the fact in the nonvolatile memory unit, and when supply of the external power is started, the power control unit determines whether the supply of the external power was stopped due to the command for stopping power supply when the fact that the power has been turned off normally is not recorded in the nonvolatile memory unit, and turns on the supply of the power to the target device when the power control unit has determined that the supply of the external power was not stopped due to the command for stopping power supply, or does not turn on the supply of the power to the target device when the power control unit has determined that the supply of the external power was stopped due to the command for stopping power supply.

2. The power control device according to claim 1, wherein the target device includes an image forming unit that forms an image in accordance with image data.

3. The power control device according to claim 1, wherein the operating unit is a push switch that notifies of whether the operating unit is pressed by the user.

4. A power control device comprising:

a power unit that generates power to be supplied to a target device, from external power;

an operating unit that receives operation of power on and power off by a user;

a nonvolatile memory unit that stores therein information;

a power control unit that turns off, when the operating unit has received operation of power off, supply of the power to the target device in a predetermined sequence for the target device and records a fact that power has been turned off normally in the nonvolatile memory unit;

a communication unit connected to an external device through a network; and a cell that supplies power to the power control unit when supply of the external power is stopped, wherein when the supply of the external power is stopped, the power control unit detects whether connection to the network through the communication unit is available and records a detection result in the nonvolatile memory unit, and when the supply of the external power is started, the power control unit determines whether the connection to the network has succeeded while the supply of the external power is stopped when the fact that the power has been turned off normally is not recorded in the nonvolatile memory unit, and turns on the supply of the power to the target device when the power control unit has determined that the connection to the network has failed while the supply of the external power is stopped, or does not turn on the supply of the power to the target device when the power control unit has determined that the connection to the network has succeeded while the supply of the external power is stopped.

5. The power control device according to claim 4, wherein the target device includes an image forming unit that forms an image in accordance with image data.

6. The power control device according to claim 4, wherein the operating unit is a push switch that notifies of whether the operating unit is pressed by the user.

* * * * *